US006641183B2

(12) United States Patent
Brown

(10) Patent No.: US 6,641,183 B2
(45) Date of Patent: Nov. 4, 2003

(54) DOOR LATCH DEVICE

(75) Inventor: Peter Edward Brown, Shropshire (GB)

(73) Assignee: Jackson Corporation, Los Angeles, CA (US)

( * ) Notice: Subject to any disclaimer, the term of this patent is extended or adjusted under 35 U.S.C. 154(b) by 0 days.

(21) Appl. No.: 09/964,913

(22) Filed: Sep. 27, 2001

(65) Prior Publication Data

US 2003/0057714 A1 Mar. 27, 2003

(51) Int. Cl.[7] ..... E05B 65/10

(52) U.S. Cl. ..... 292/92; 292/DIG. 62; 70/92

(58) Field of Search ..... 292/92, DIG. 62, 292/336, 21; 70/92

(56) References Cited

U.S. PATENT DOCUMENTS

| | | | | | |
|---|---|---|---|---|---|
| 1,564,184 | A | * | 12/1925 | Prinzler | 292/341.17 |
| 3,029,096 | A | * | 4/1962 | Welch | 292/336 |
| 3,123,387 | A | * | 3/1964 | Jackson et al. | 292/21 |
| 3,319,986 | A | * | 5/1967 | Balducci | 292/92 |
| 3,334,500 | A | | 8/1967 | Bejarano | |
| 3,583,740 | A | * | 6/1971 | Armstrong | 292/198 |
| 3,614,145 | A | * | 10/1971 | Zawadski | 292/92 |
| 3,663,047 | A | * | 5/1972 | Zawadzki | 292/92 |
| 3,730,574 | A | * | 5/1973 | Zawadzki | 292/92 |
| 3,751,088 | A | * | 8/1973 | Schlage et al. | 292/201 |
| 3,776,582 | A | * | 12/1973 | Balducci | 292/92 |
| 3,788,687 | A | * | 1/1974 | Zawadzki | 292/92 |
| 3,854,763 | A | * | 12/1974 | Zawadzki et al. | 292/201 |
| 3,877,262 | A | * | 4/1975 | Williams | 70/92 |
| 3,888,046 | A | * | 6/1975 | Meisterheim | 49/319 |
| 3,940,886 | A | | 3/1976 | Ellingson, Jr. | |
| 3,993,335 | A | | 11/1976 | Schmidt | |
| 4,470,625 | A | * | 9/1984 | Walsh et al. | 292/201 |
| 4,624,490 | A | * | 11/1986 | Miller | 292/92 |
| 4,819,976 | A | * | 4/1989 | Bert | 292/48 |
| 4,839,988 | A | | 6/1989 | Betts et al. | |
| 4,968,070 | A | * | 11/1990 | Choi | 292/92 |
| 4,976,476 | A | * | 12/1990 | Cross et al. | 292/92 |
| 5,114,192 | A | * | 5/1992 | Toledo et al. | 292/21 |
| 5,169,185 | A | * | 12/1992 | Slaybaugh et al. | 292/92 |
| 5,219,385 | A | * | 6/1993 | Yeh | 70/92 |
| 5,340,171 | A | * | 8/1994 | Slaybuagh et al. | 292/21 |
| 5,605,362 | A | * | 2/1997 | Surko, Jr. | 292/92 |
| 5,702,134 | A | * | 12/1997 | Hsieh | 292/92 |
| 5,762,385 | A | * | 6/1998 | Mader et al. | 292/219 |
| 5,816,017 | A | * | 10/1998 | Hunt et al. | 52/784.11 |
| 6,000,733 | A | * | 12/1999 | Linder | 292/92 |
| 6,009,732 | A | * | 1/2000 | Haeck et al. | 70/92 |
| 6,048,000 | A | * | 4/2000 | Geringer et al. | 292/92 |
| 6,145,897 | A | * | 11/2000 | Locher | 292/92 |

FOREIGN PATENT DOCUMENTS

| | | | | |
|---|---|---|---|---|
| CH | 1113131 A2 | * | 4/2001 | 292/92 |

* cited by examiner

*Primary Examiner*—William L. Miller
*Assistant Examiner*—Carlos Lugo
(74) *Attorney, Agent, or Firm*—Sonnenschein Nath & Rosenthal LLP

(57) ABSTRACT

A latch mechanism is provided for a door which includes a rotatable latch which is rotated into and held in an open position to allow the door to open, and is released from the open position only when a sensing mechanism provided as a part of the latch mechanism, held in the door, senses the door frame upon a closing of the door. The latch is held in an over center engaged position which it is moved into due to a lost motion connection among some, but not all, elements of the latch mechanism.

3 Claims, 8 Drawing Sheets

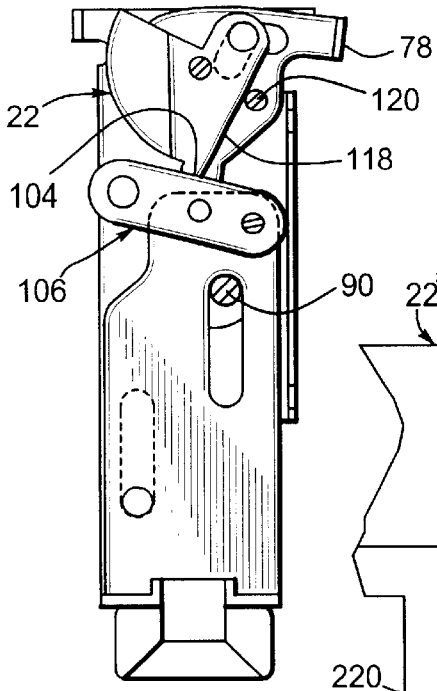
FIG. 15
FIG. 32
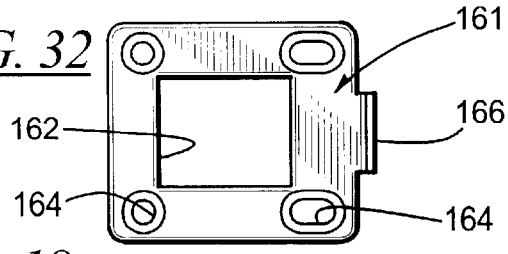
FIG. 18
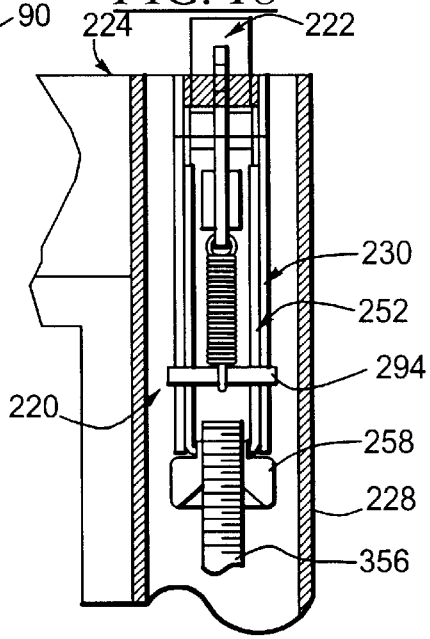
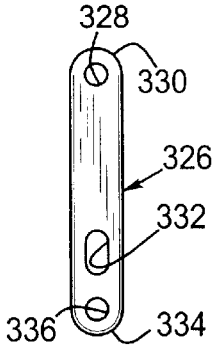
FIG. 27
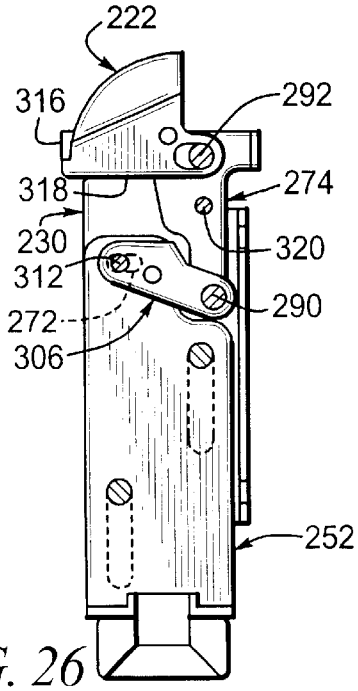
FIG. 26
FIG. 28
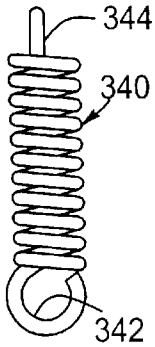
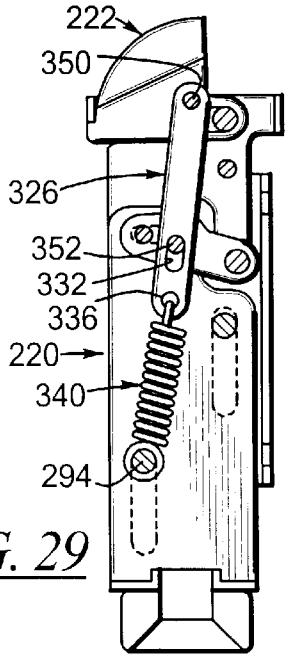
FIG. 29

DOOR LATCH DEVICE

BACKGROUND OF THE INVENTION

The present invention generally relates to a door latch device. In particular, the invention relates to structures and methods for a door latch device used with a panic device for doors wherein the locking as well as the unlocking of the door can be controlled by the door latch device.

Panic devices for doors have been in use in buildings for approximately 100 years and provide a useful means for allowing unrestricted escape from the building in situations such as an emergency, while providing a reasonable amount of security against unauthorized access. Panic devices are generally used on single action outward opening doors and provide retention within the door frame either into the threshold, transom or door frame to hold the door in the closed position when not in use.

There are numerous types and styles of mechanisms used for operating the panic devices where bolts reciprocate vertically in and out of the door frame and extend from the top and bottom of the door. Most of these mechanisms include or are adapted to include a panic bar release arrangement on the inside of the door for rapid and foolproof actuation of the bolts by merely depressing the panic bar to open the door. Many of such mechanisms include an often desirable feature of permitting manipulation of the panic device to latch the bolts in a retracted position during business hours or the like, whereby the door is free to swing open without operating the panic bar or hitting any other release mechanism.

To provide operation of installations of this type, some form of bolt latching mechanism is usually provided which retains the bolts in the retracted position when the interior or exterior actuating device is operated during the time the door is open. This prevents the need to continue pressure on the panic bar or key in order to prevent the bolt from contacting the ground or door frame while the door is swinging during the open and closed cycles.

A problem with these types of mechanisms, however, is that these mechanisms use a keeper plate or trip mounted on the door frame which is an added component to the door assembly. Thus, the added component increases the assembly required to install the door, resulting in higher installation costs. Further, the added component increases the chance for the component to fail, resulting in costly repairs, inefficient use of work space, and unsafe conditions. Further, the bolts in these mechanisms commonly fail to remain in the retracted position when the door has been opened, resulting in damage to the frame or threshold since the bolt strikes the frame or threshold upon closing.

A need, therefore, exists to safely and clearly open a door with a panic device. The solution, however, must be able to retain the bolting mechanism in the retracted position until the door has completely closed. Further, the solution must be capable of sensing that the door has closed to extend the bolt after the door has completely closed.

An example of a current panic device wherein the bolts may be retracted is a key operated lock which also services to lock the bolts in the retracted position. By depressing a panic bar, as described in the United States patent to T. Bejarano, U.S. Pat. No. 3,334,500 the bolts may be retracted. Other examples of such devices wherein the bolts may be retracted by a panic device are described in U.S. Pat. No. 3,993,335 to Schmidt, U.S. Pat. No. 3,940,886 to Ellingson, Jr., and U.S. Pat. No. 4,839,988 to Betts et. al.

Currently, other panic devices use Pullman latches which rotate about a horizontal axis and use a spring loaded mechanism. These panic devices usually consist of a mechanical system concealed within the vertical lock stile of the door connected with a surface mounted actuating push bar or pad mounted horizontally across the inside face of the door. The two parts of the system are normally linked mechanically. The mechanism within the door stile operates a latch or bolt system which retains the door in the closed position. In this system, the latch or bolt is retained in a keeper plate which is mounted on the door frame.

These mechanisms also do not solve the current need since the bolts often do not stay in the retracted position and drag along the ground or across the door frame. Further it is often the case that the door mounted components are installed by the door manufacture in the door assembly and the frame components such as keeper plates are sent to the site separately to be installed after the door frame has been erected. Frequently, the frame mounted components go astray and often the components are installed with less accuracy than can be achieved in the factory. This can lead to potentially dangerous situations should the device fail to open in an emergency.

SUMMARY OF THE INVENTION

The present invention provides an improved latching device that can keep the latch assembly in the disengaged position until after the door has closed. This leads to improved safety and maintenance on the door and door frame. The present invention can also be used without keeper plates and does not require a separate trip device mounted to the frame. This leads to installation cost reductions and improved safety for the occupants of the building.

Thus, there is provided by the invention disclosed herein an improved door latch device which overcomes many of the inadequacies of door latches known to the prior art. The invention provides for the mounting of a novel door latch device on the internal side of the door for providing a latch assembly which, rather than vertically extending from the door to engage the door frame, rotatably engages and disengages the door frame. This door latch device, upon mechanical instructions from the actuation of the panic exit device, or other device such as a key lock, is rotated into a disengaging and engaging position, respectively, to allow the door to be opened and to be closed.

In an embodiment, the door latch device comprises at least one housing fixed within the door stile and at least one fork positioned inward of the housing and slidably engaged to the housing. The door latch device further comprises a latch assembly rotatably mounted to the housing and mechanically connected to the fork. The latch assembly is rotatable from an engaged position in a first rotational direction to a disengaged position to allow the door to open. The latch assembly also is rotatable from the disengaged position to the engaged position in a second rotational direction to engage the door frame after the door has closed.

In an embodiment, the latch assembly comprises a latch rotatably connected to the housing. Additionally, a pair of linkages are positioned below the latch and rotatably connected to the housing. A pair of connecting rods are positioned between the latch and the pair of linkages and are slidably engaged to the pair of linkages. Further, a bias member is fixed to the pair of connecting rods and to the fork. The latch assembly further comprises a rocker element positioned between the housing and the latch wherein the rocker element is rotatably connected to the housing and slidably engaged within the latch.

The pair of linkages have a linkage pin positioned in the middle of the linkages while the connecting rods each have a rod slot for receiving the linkage pin.

The latch has a projection facing the door stile in the engaged position and rotated downward ninety degrees in the disengaged position. The latch further has a latch aperture positioned opposite the projection wherein the latch aperture is rotatably connected to the housing. The rocker element has a rocker pin positioned to mechanically connect to the projection during the second rotational direction. The rocker element further has a bridge positioned within the door stile in the engaged position and positioned outside the door stile in the disengaged position.

The present invention further provides a method of engaging and disengaging a door latch device for a door fitted in a door frame comprised of activating the fork in a downward direction. Thereupon, the latch assembly is rotated from an engaged position in the first rotational direction to a disengaged position to disengage from the door frame. A lost motion arrangement, preferably in the form of slot and pin connections between the housing and the fork permit the latch to be captured in an over center position and held against returning to the latched position while the door remains open. The method also provides for sensing the door frame by the latching mechanism upon the closing of the door. Further, the latch is rotated from the disengaged position to the engaged position in a second rotational direction to engage the door frame after the door frame has been sensed.

An advantage of the present invention is to provide a door latch device that efficiently retains and releases a door.

Another advantage of the present invention is to provide a latch assembly that moves from an engaged position to a disengaged position when the door is opened.

Another advantage provided by the present invention is the automatic sensing of the door frame during a closing movement of the door.

Another advantage of the present invention is to provide a latch assembly that automatically moves from the disengaged position to the engaged position when the door frame is sensed.

Another advantage is to provide a lost motion effect to prevent the latch from returning to the latched position while the door is open.

Another advantage of the present invention is to provide a door latch device eliminating a striker plate and/or a trip mechanism mounted to the door or frame.

Still further advantages will become apparent from a consideration of the following descriptions and drawings.

BRIEF DESCRIPTION OF THE DRAWINGS

FIG. 15 is a partially disassembled side elevational view of the door latch device of FIG. 1 in the unlatched position.

FIG. 18 is a cross sectional view of the door latch device of FIG. 17 rotated 90 degrees about a vertical axis.

FIG. 26 is a more complete (than FIG. 23) partially assembled side elevational view of the door latch device of FIG. 17.

FIG. 27 is an isolated cross sectional view of a rod portion of the door latch device of FIG. 17.

FIG. 28 is an isolated cross sectional view of a biasing member portion of the door latch device of FIG. 17.

FIG. 29 is a completely assembled side elevational view of the door latch device of FIG. 17 in the latched position.

FIG. 32 is a plan view of the plate shown in FIG. 16, here shown in isolation.

DETAILED DESCRIPTION OF THE PREFERRED EMBODIMENTS

Figures 1, 2:
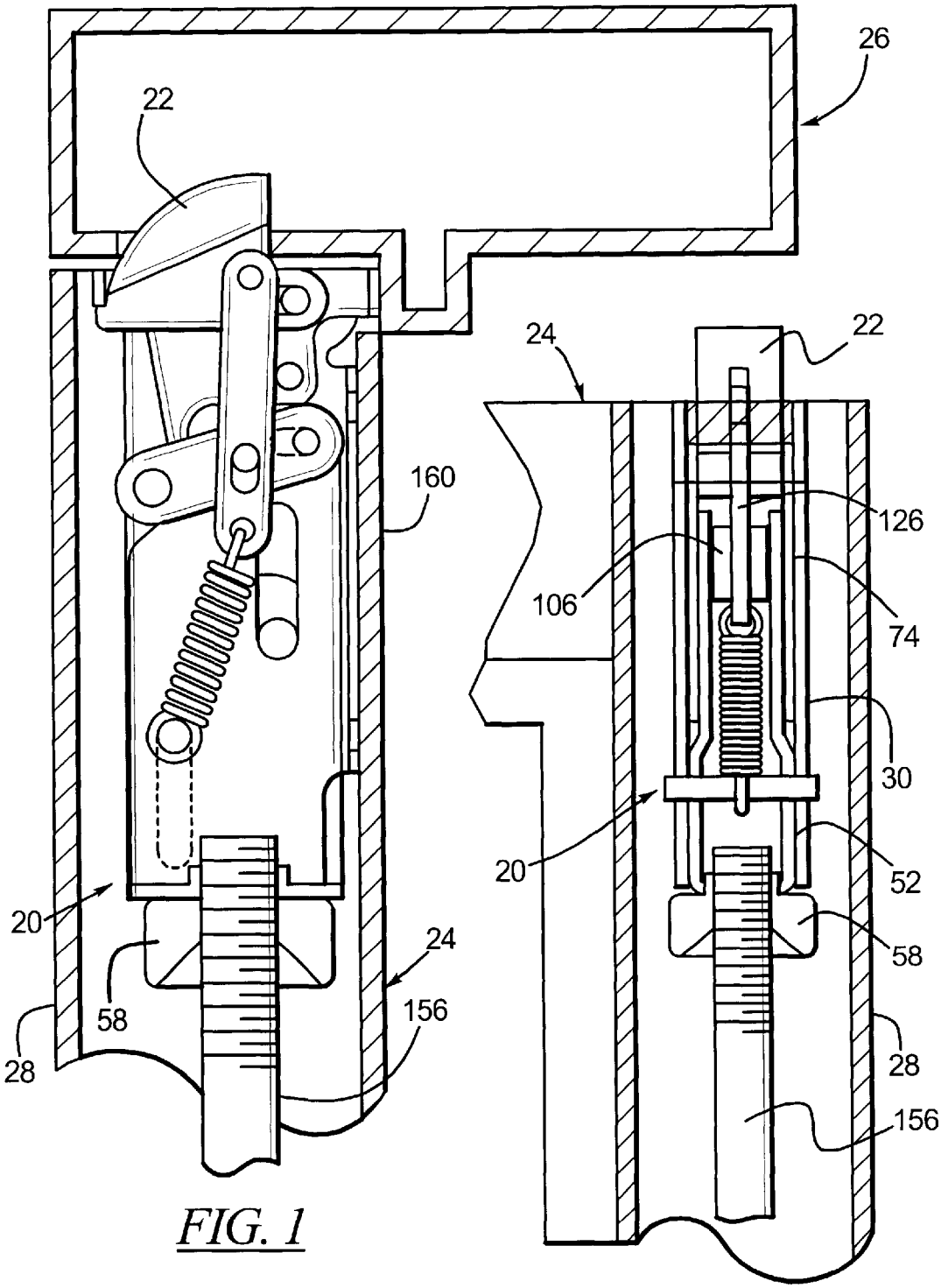
FIG. 1 is a cross sectional view of a door latch device illustrated in an engaged position embodying the principles of the present invention.
FIG. 2 is a cross sectional view of the door latch device of FIG. 1 rotated 90 degrees about a vertical axis.

While the present invention may be embodied in many different forms, there is shown in the drawings and discussed herein one or more specific embodiments of a door latch device 20 embodying the principles of the present invention with the understanding that the present disclosure is to be considered only as an exemplification of the principles of the invention and is not intended to limit the invention to the embodiments illustrated.

As discussed above, the present invention provides a structure and method to maintain a door latch 22 in a disengaged position until a door 24 which it is mounted on has completely closed. The door latch device 20 of the present invention efficiently and safely retracts and extends the door latch 22 during the opening and closing of the door 24 relative to a door frame 26.

The door latch device 20 of the present invention is to be mounted on the door 24 which has an active style 28 and an inactive style (not shown), it being understood that the term "active style" merely refers to the edge of the door which opens and closes and the inactive style refers generally to the hinged edge of the door. Although the active style 26 as depicted is of a design suitable for specific types of doors, it is within the scope of the invention to mount the door latch device 20 on any type of door having an active style as hereinafter described.

FIGS. 1 and 2 illustrate, in cross sectional views, an exemplary door latch device 20 which is used to engage and disengage the door 24 relative to the frame 26. FIGS. 1 and 2 illustrate the door latch device in a condition where the latch 22 is extended and in FIG. 1 is illustrated as being engaged with the frame 26.

The door latch device 20 is comprised of a plurality of individual components, each of which are shown in detail in isolated views in FIGS. 3–9.

Figure 3:
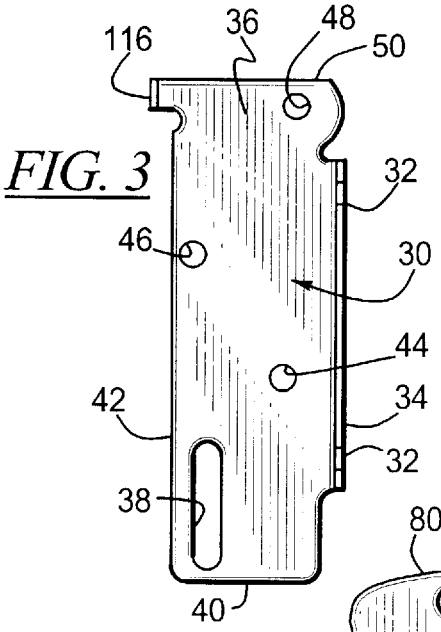
FIG. 3 is an isolated cross sectional view of a housing portion of the door latch device of FIG. 1.

FIG. 3 illustrates a housing 30 which is secured to the door style 28, for example, by threaded fasteners extending into apertures 32 formed in an end wall 34 of the housing 30. The housing preferably is formed in a U-shape with two side legs 36 and with the wall 34 forming the bight of the U. The two side legs are mirror images of each other and therefore only one of the side legs is shown in FIG. 3.

The side legs are provided with four apertures for receiving pins. A first aperture 38 is in the form of a vertical slot and is located near a lower edge 40 and a free edge 42 of the housing 30. A second aperture 44 is located above the first aperture and toward the bight wall 34. The third aperture 46 is above the second aperture and is located adjacent to the free edge 42. The fourth aperture 48 is located near a top edge 50 of the housing 30 and toward the bight side 34.

Figure 4:
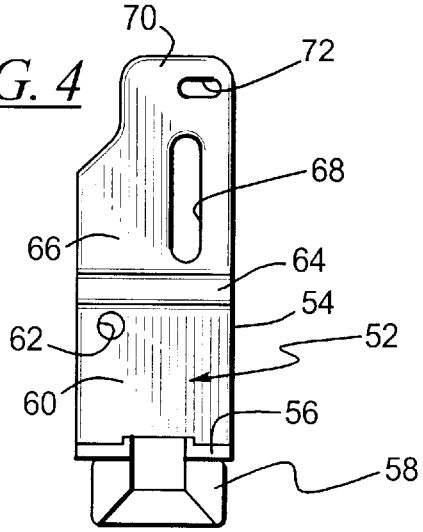
FIG. 4 is an isolated cross sectional view of a fork portion of the door latch device of FIG. 1.

FIG. 4 illustrates a fork 52 which also may be formed in a U-shape with two mirror image legs 54 and a lower bight wall 56 of the U. An adapter 58, in the form of an internally threaded nut is captured on the bight wall 56 by an appropriate crimping operation. The fork 52 is received within the housing 30 and, as seen best in FIG. 2, a lower portion of the fork legs 60 is provided with sliding clearance within the side legs 36 of the housing. This portion of the fork legs includes an aperture 62 for receiving a pin that also extends through the slot 38 of the housing as described below.

Fork side leg 54 has an inward jog section 64 and a vertical upper section 66 spaced slightly inwardly of the side legs 36 of the housing as seen in FIG. 2. In the upper section 66 of the leg 54, there is provided a vertical slot 68 which receives a pin (described below) that also extends through aperture 44 in the housing. Near a top end 70 of the upper section 66 is a horizontal slot 72 to receive a pin to be described below.

Figure 5:
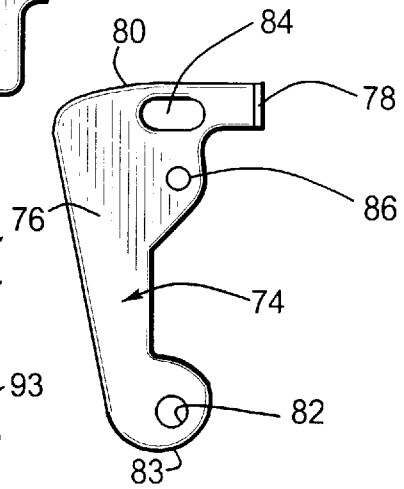
FIG. 5 is an isolated cross sectional view of a rocker portion of the door latch device of FIG. 1.

FIG. 5 illustrates a rocker member 74 which has two legs 76 which are mirror shaped and may be connected by a bridge 78 extending between an upper end 80 of the two legs 76. Alternatively, two separate rockers may be provided which have an inturned portion corresponding to the bridge 78, which, however, do not extend across the full distance between the two separate rockers. An aperture 82 is provided near a lower end 83 of the rocker leg 76 for receiving a pin (described below) that also extends through aperture 44 in the housing and slot 68 in the fork. Near the upper end 80 of the rocker leg 76 is provided a generally horizontal slot 84 to receive a pin also extending through aperture 48 in the housing. Positioned below the slot is an aperture 86 to receive a rocker pin as described below.

Figure 6:
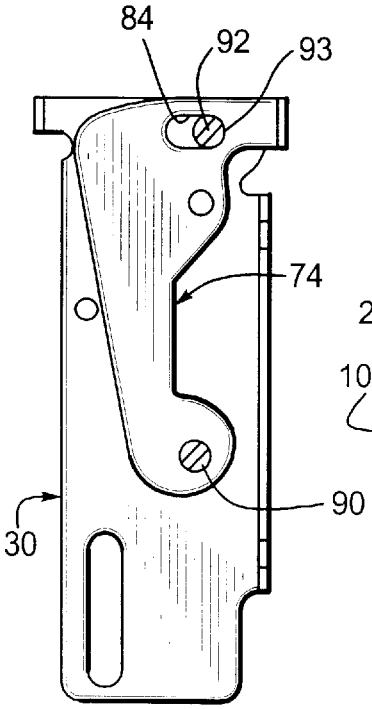
FIG. 6 is a partially assembled side elevational view of the door latch device of FIG. 1.

FIG. 6 is a cross section illustrating the arrangement of the rocker 74 relative to the housing 30 and illustrating a pin 90 extending through the aperture 82 in the rocker and aperture 44 in the housing, as well as a pin 92 extending through the slot 84 in the rocker 74 and the aperture 48 in the housing. The rocker 74 is arranged to pivot about the pin 90 through a range constrained by the length of the slot 84 which receives the pin 92. As illustrated, the rocker 74 is pivoted counter clockwise so that the pin 92 rests against a right hand edge 93 of the slot 84.

Figure 7:
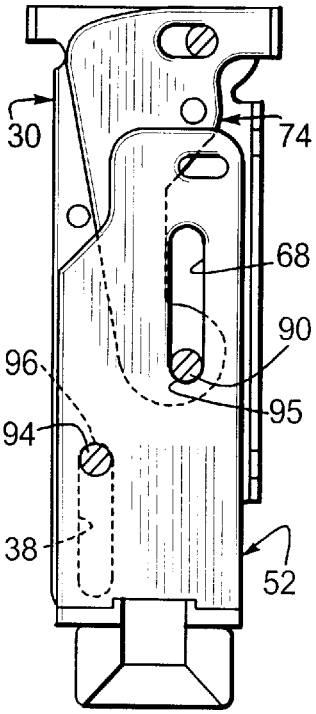
FIG. 7 is a more complete (than FIG. 6) partially assembled side elevational view of the door latch device of FIG. 1.

FIG. 7 illustrates the placement of the fork 52 into assembly with the housing 30 and the rocker 74. Here it is seen that the pin 90 is further received in the slot 68 of the fork 52 and that a pin 94 is received in the aperture 62 in the fork and also in the slot 38 of the housing 30. The fork 52 can slide vertically within the housing, constrained by the dimension of the slot 68 and the slot 38. As illustrated in FIG. 7, the fork 52 is slid upwardly to the greatest extent possible within the housing 30 such that the pin 90 rests on a bottom 95 of the slot 68 and the pin 94 engages a top 96 of the slot 38 of the housing.

Figure 8:
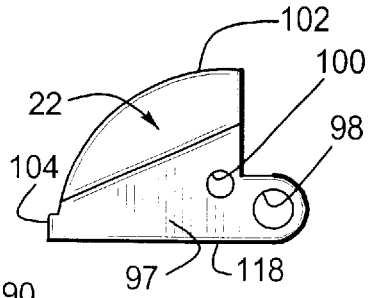
FIG. 8 is an isolated cross sectional view of a latch portion of the door latch device of FIG. 1.

FIG. 8 illustrates the latch 22 which has a first aperture 98 for pivotally receiving the pin 92 which extends through the housing 30 and the rocker 74. A second aperture 100 is provided for receiving a pin described below. The latch 22 has a curved top portion 102 which extends the full width of the latch 22. At an end of the leg 97 opposite the aperture 98 is a projection 104 which protrudes slightly beyond the curved portion 102.

Figure 9:
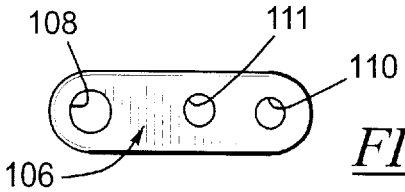
FIG. 9 is an isolated cross sectional view of a link portion of the door latch device of FIG. 1.

FIG. 9 illustrates one of two link members 106. Each link member has a first aperture 108 near one end to receive a pin (described below) extending through the housing aperture 46, a second aperture 110 near an opposite end to receive a pin (described below) extending through the slot 72 in the fork 52 and a third, central aperture 111 to receive a link pin as described below.

Figure 10:
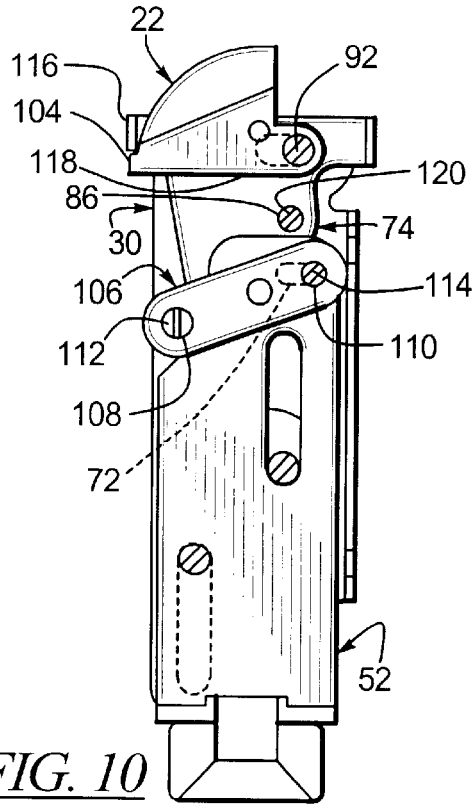
FIG. 10 is a more complete (than FIG. 7) partially assembled side elevational view of the door latch device of FIG. 1.

FIG. 10 illustrates the placement of the latch 22 and the link 106 onto the assembly of the housing 30, the rocker 74 and the fork 52. Here it is seen that the latch 22 is pivotally mounted on the pin 92 and is free to rotate about that pin. The link 106 is pivotally received on a pin 112 which is received in the aperture 46 of the housing 30. The aperture 110 receives a pin 114 which is received in the slot 72 of the fork 52. The link 106 is free to pivot about the pin 112 and is constrained only due to the connection of the link 106 to the fork 52 through the pin 114, with the fork 52 being limited in its vertical motion by the pins 90 and 94 received in the slots 68 and 38 as described above. As illustrated, the link 106 is rotated about the pin 112 to its counter clockwisemost position since the fork 52 is in its uppermost position relative to the housing 30.

The latch 22 is free to pivot about the pin 92 through an arc where at the clockwisemost position, the projection 104 will engage an inturned tab 116 on the housing 30 and, in a counter clockwisemost position, an edge 118 of the latch 22 will engage a pin 120 carried in the aperture 86 of the rocker 74. As illustrated in FIG. 10, the latch 22 is in its clockwisemost (engaged) position.

Figure 11:
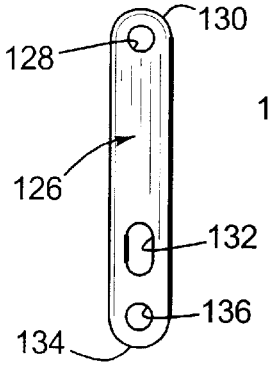
FIG. 11 is an isolated cross sectional view of a rod portion of the door latch device of FIG. 1.

FIG. 11 illustrates one of two identical rod members 126. The rod member 126 has a first aperture 128 near a top end 130 which receives a latch pin (described below) carried in the latch aperture 100. The rod member 126 has a vertical slot 132 positioned toward, but spaced above a bottom end 134 for receiving a pin (described below) carried in the aperture 111 of the link 106 as described below. The rod member 126 further has an aperture 136 near the bottom end 134.

Figure 12:
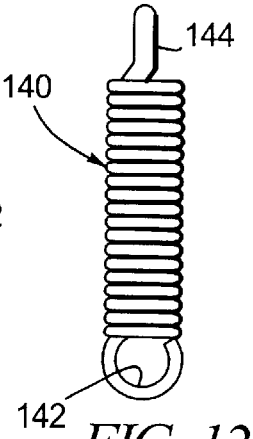
FIG. 12 is an isolated cross sectional view of a biasing member portion of the door latch device of FIG. 1.

FIG. 12 illustrates a biasing member 140 which may be in the form of a coil spring. The coil spring has a first eye 142 for receiving the pin 94 which extends through the housing 30 and the fork 52. An eye 144 is located at the opposite end of the biasing member 140 and is received in the aperture 136 in the rod member 126.

Figure 13:
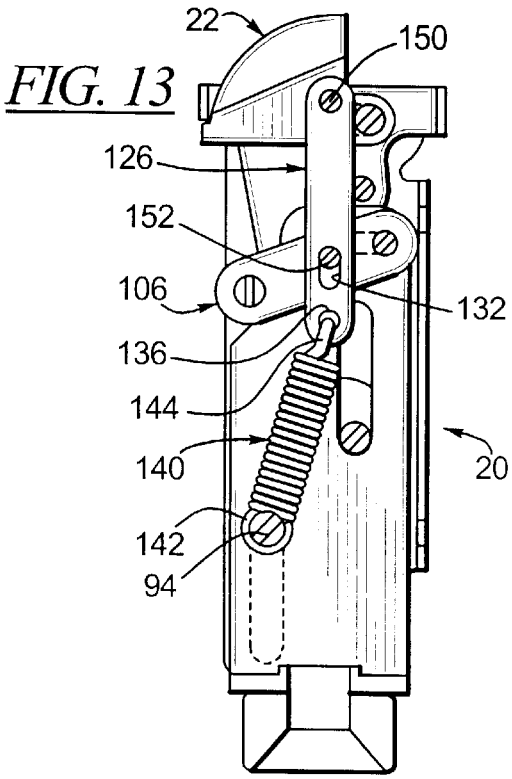
FIG. 13 is a completely assembled side elevational view of the door latch device of FIG. 1 in the latched position.

FIG. 13 illustrates the further assembly of the rod member 126 and the biasing member 140 on to the assembly illustrated in FIG. 10. Here it is seen that the biasing member 140 is captured at the lower end eye 142 by the pin 94 and at its upper end eye 144 by the aperture 136 in the rod 126. The rod 126 is pivotally captured on a latch pin 150 which is received in the latch aperture 100. A link pin 152 is received in the slot 132 of the rod member 126 and also extends into the aperture 111 of the link 106. Thus, FIG. 13 illustrates the door latch mechanism 20, and each of its component parts, in the latched position in which the latch 22 would be engaged with the door frame 26.

Figure 14:
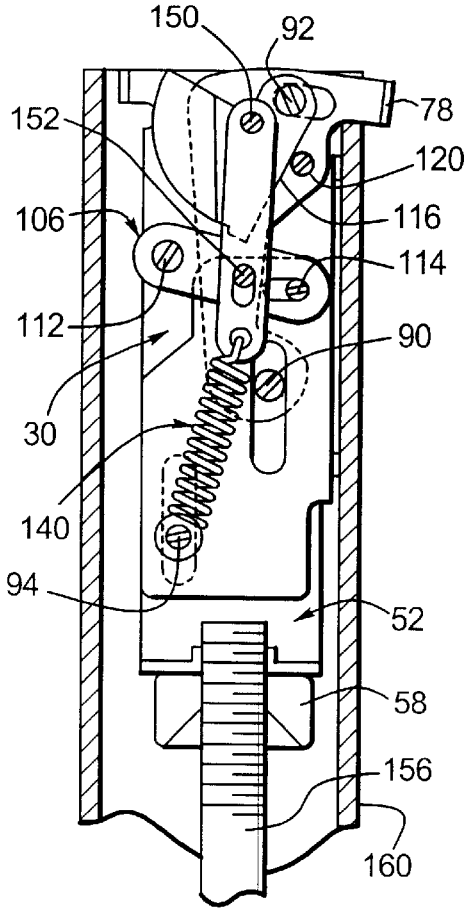
FIG. 14 is a completely assembled side elevational view of the door latch device of FIG. 1 in the unlatched position.
Figure 33:
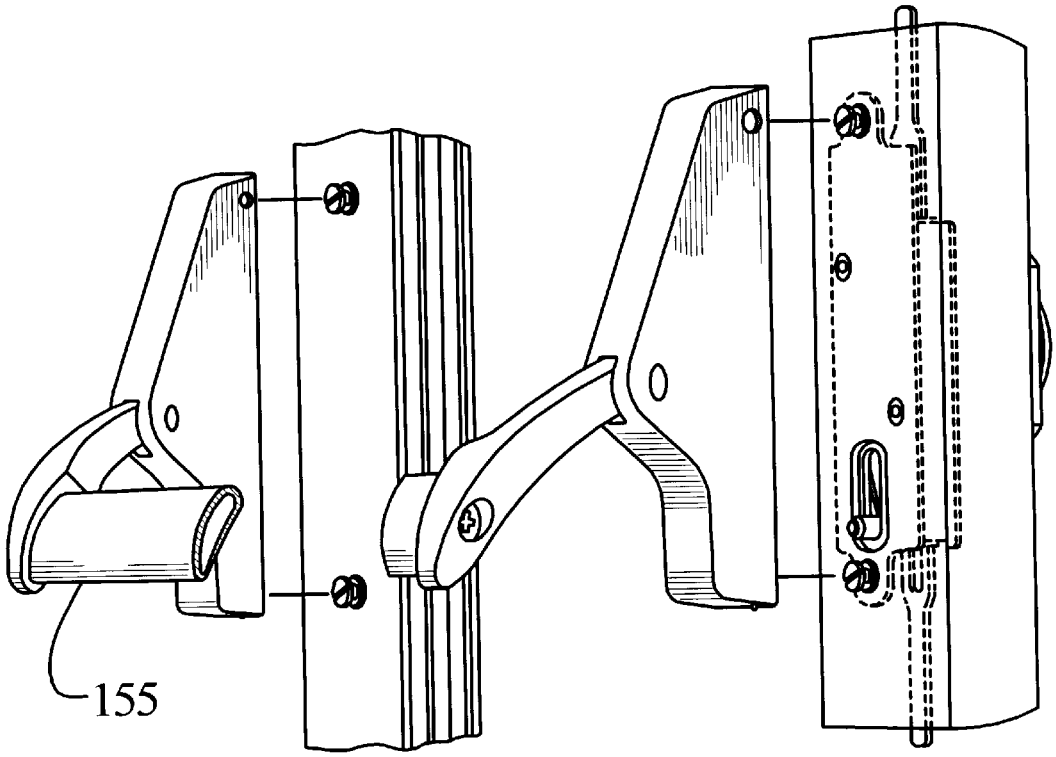
FIG. 33 is a fragmentary perspective view of a door latch device with a push bar actuator.

The door latch mechanism 20 is moved to an unlatched position by operation of a panic bar or push bar 155 shown in FIG. 33 and described in U.S. Pat. No. 3,993,335 incorporated herein by reference which causes a threaded rod 156 (FIGS. 1 and 2) to move downwardly, the threaded rod 156 being threadingly engaged in the adapter 58, thereby causing the fork 52 to move downwardly relative to the housing 30. This downward movement of the fork 52 carries the pin 94 downwardly, as well as the pin 114, thereby pulling the biasing member 140 downwardly and rotating the link 106 in a clockwise direction about the pin 112. This pivotal movement of the link 106 and the downward force provided by the biasing member 140 moves the rod member 126 downwardly, thereby causing the latch 22 to pivot about the pin 92 in a counter clockwise direction until the edge 118 of the latch engages the rocker pin 120. The engagement of the edge 118 with the rocker pin 120 will cause the rocker 74 to pivot about the pin 90 in a clockwise direction, thus resulting in the bridge 78 protruding beyond an inner face 160 of the door 28. This resulting condition of the latch mechanism is illustrated in FIG. 14.

When the pressure on the panic bar is released, there no longer is a downward force being exerted by the threaded rod 156, and therefore the biasing member 140 exerts an upward force on the pin 94 to move the fork 52 upwardly relative to the housing 30. However, the projection 104 of the latch 22 engages the links 106 in an over center condition preventing clockwise rotation of the latch 22 and thereby stopping the upward movement of the fork 52 due to the rod member 126 and its connection to the latch at pin 150 and the link 106 connection at the pin 114 to the fork 52. The slots 68 in the fork 52 and 38 in the housing 30 allow for lost motion to occur, permitting a slight upward movement of the fork 52 relative to the housing 30 before the projection 104 engages the links 106.

FIG. 15 illustrates the engagement of the latch 22 with the links 106, with visibility blocking components removed. In this manner, the latch 22 will be retained in its unlatched position while the door remains open, even though pressure has been released on the panic bar.

When the door 24 returns to its closed position relative to the door frame 26, the bridge 78, which is now projecting beyond the face 160 of the door, will engage the door frame 26 and will cause the rocker 74 to pivot about the pin 90, causing the rocker pin 120 to press against the edge 116 of the latch 22 until the projection 104 moves past "dead center" on the links 106, which will then release the restraint preventing the biasing member 140 from pulling upwardly on the pin 94. With this restraint released, pin 94 will be drawn upwardly, thereby carrying the fork 52 upwardly and pivoting the links 106 about the pin 112, the upward movement of the pin 114 thereby carrying the rod member 126 upwardly, causing the latch 22 to pivot about the pin 92 through the connection of the rod member 126 at the pin 150 to the latch member 22. The end result of this movement will be a return to the latched condition as illustrated in FIG. 1. Therefore, it is seen that the door latch mechanism of the present invention utilizes a lost motion arrangement in order to trap the latch 22 against returning to the latched position upon a release of the panic push bar. Also, the present invention utilizes the concept of rotating the latch 22 beyond a top dead center relative to the links 106 to trap the latch 22 against returning to the latched position upon release of the panic exit bar.

The present invention utilizes a frame sensor, in the form of the rocker 74 with its rocker pin 120, to reactivate the latch 22 and move it back to the latched position by pushing the latch 22 over the top dead center position relative to the link 106.

The present invention does not require a separate striker plate or trip mechanism mounted on the door frame in order to reactivate the latch mechanism.

Figure 16:
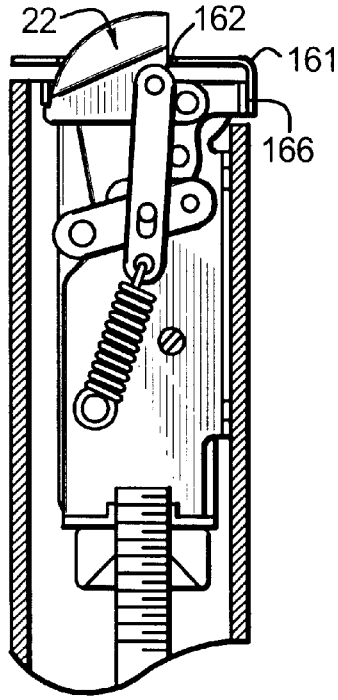
FIG. 16 is a completely assembled side elevational view of the door latch device of FIG. 1 in the latched position and including the use of a plate to protect a relatively soft wooden door.

Although the invention is illustrated in FIGS. 1 and 2 as being located within a metal door, it can also be utilized in other doors, for example, wood doors. In such an arrangement it may be necessary to utilize an additional plate 161 mounted at the top of the door to protect the relatively soft material of the door frame. The plate 161 is shown in place in FIG. 16 and in an isolated view in FIG. 32, where it is seen that it has a large central aperture 162 to allow the latch 22 to extend through the plate into the latching position and its also includes several apertures 164 for receiving fasteners to secure the plate 161 to the door 24. A tab 166 may be provided to prevent damage to the door frame 26 when the bridge 78 of the rocker 74 engages the door frame 26. The tabs 166 is positioned a set distance from aperture 162 in order that free play is minimized between the door and frame when the latch is engaged.

An alternative embodiment of the present invention is shown in FIGS. 17–34 which includes a door latch device 220 embodying the principles of the present invention.

As discussed above, the present invention provides a structure and method to maintain a door latch 222 in a disengaged position until a door 224 which it is mounted on has completely closed. The door latch device 220 of the present invention efficiently and safely retracts and extends the door latch 222 during the opening and closing of the door 224 relative to a door frame 226.

The door latch device 220 of this embodiment is to be mounted on the door 224 which has an active style 228 and an inactive style (not shown), it being understood that the term "active style" merely refers to the edge of the door which opens and closes and the inactive style refers generally to the hinged edge of the door. Although the active style 226 as depicted is of a design suitable for specific types of doors, it is within the scope of the invention to mount the door latch device 220 on any type of door having an active style as hereinafter described.

Figure 17:
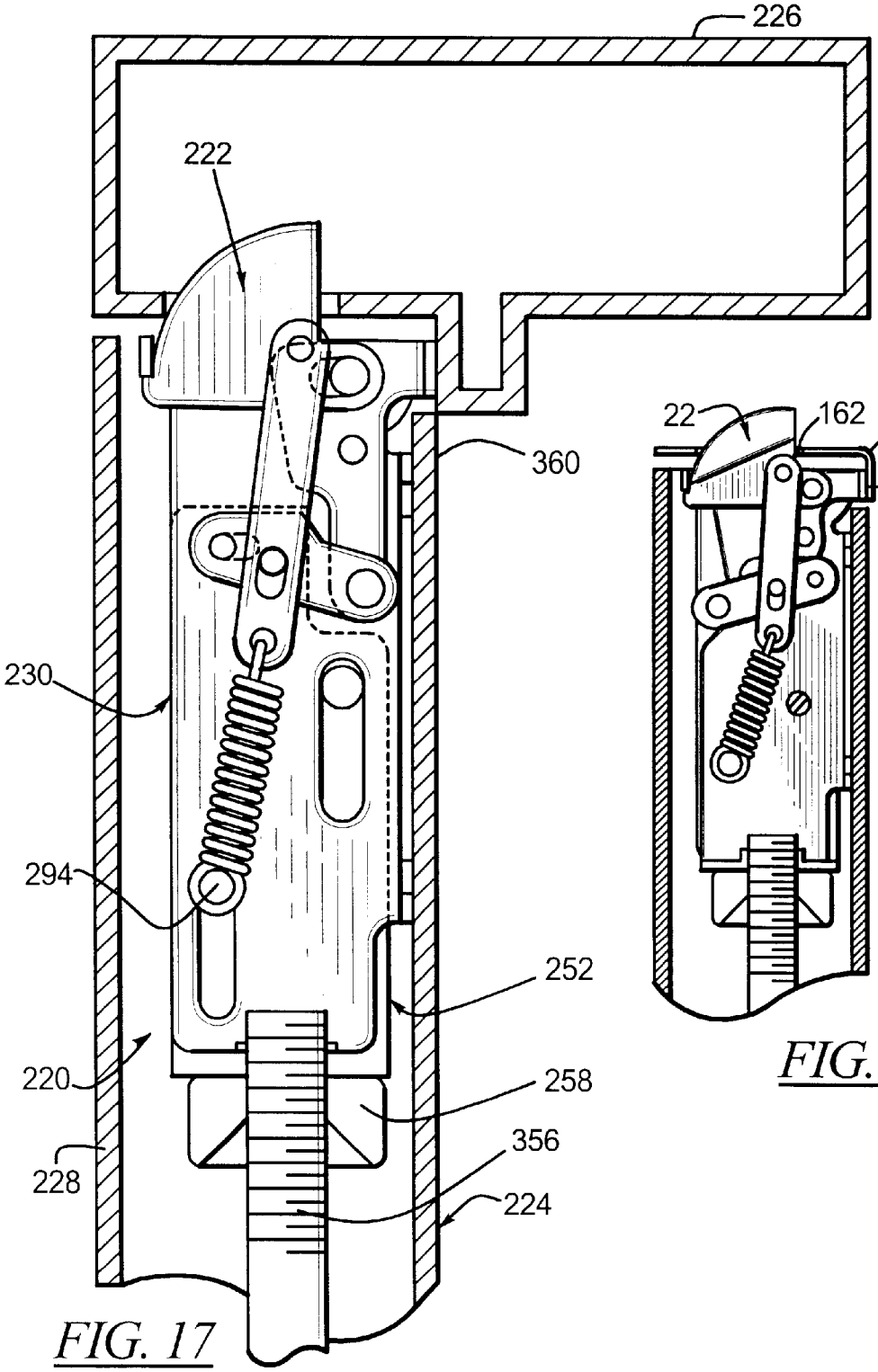
FIG. 17 is a cross sectional view of a second embodiment of a door latch device illustrated in an engaged position embodying the principles of the present invention.

FIGS. 17 and 18 illustrate, in cross sectional views, an exemplary door latch device 220 which is used to engage and disengage the door 224 relative to the frame 226. FIGS. 17 and 18 illustrate the door latch device 220 in a condition where the latch 222 is extended and in FIG. 17 is illustrated as being engaged with the frame 226.

The door latch device 220 is comprised of a plurality of individual components, each of which are shown in detail in isolated views in FIGS. 19–28.

Figure 19:
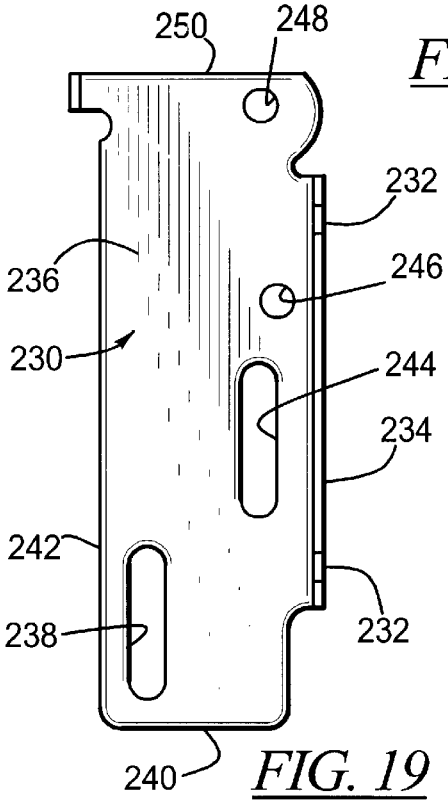
FIG. 19 is an isolated cross sectional view of a housing portion of the door latch device of FIG. 17.

FIG. 19 illustrates a housing 230 which is secured to the door style 228, for example, by threaded fasteners extending into apertures 232 formed in an end wall 234 of the housing 230. The housing preferably is formed in a U-shape with two side legs 236 and with the wall 234 forming the bight of the U. The two side legs are mirror images of each other and therefore only one of the side legs is shown in FIG. 19.

The side legs 236 are provided with four apertures for receiving pins. A first aperture 238 is in the form of a vertical slot and is located near a lower edge 240 and a free edge 242 of the housing 230. A second aperture 244 is located above the first aperture and toward the bight wall 234 and is also in the form of a vertical slot. The third aperture 246 is above the second aperture and is located adjacent to the bight wall 234. The fourth aperture 248 is located near a top edge 250 of the housing 230 and toward the bight wall 234.

Figure 20:
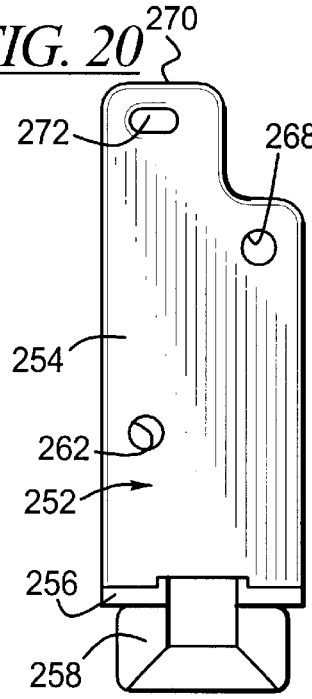
FIG. 20 is an isolated cross sectional view of a fork portion of the door latch device of FIG. 17.

FIG. 20 illustrates a fork 252 which also may be formed in a U-shape with two mirror image legs 254 and a lower bight wall 256 of the U. An adapter 258, in the form of an internally threaded nut is captured on the bight wall 256 by an appropriate crimping operation. The fork 252 is received within the housing 230 and, as seen best in FIG. 18, the fork legs 254 are provided with sliding clearance within the side legs 236 of the housing 230. The fork legs 254 include an aperture 262 for receiving a pin that also extends through the slot 238 of the housing 230 as described below.

In an upper section of the legs 254, there is provided an aperture 268 which receives a pin (described below) that also extends through aperture 244 in the housing. Near a top end 270 of the legs 254 is a horizontal slot 272 to receive a pin to be described below.

Figure 21:
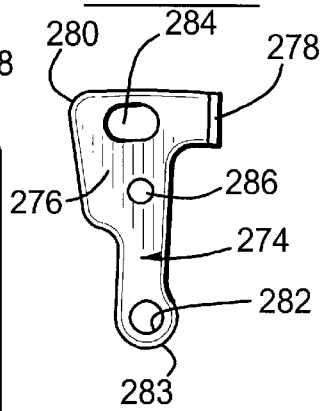
FIG. 21 is an isolated cross sectional view of a rocker portion of the door latch device of FIG. 17.

FIG. 21 illustrates a rocker member 274 which has two legs 276 which are mirror shaped and may be connected by a bridge 278 extending between an upper end 280 of the two legs 276. Alternatively, two separate rockers may be provided which have an inturned portion corresponding to the bridge 278, which, however, do not extend across the full distance between the two separate rockers. An aperture 282 is provided near a lower end 283 of the rocker leg 276 for receiving a pin (described below) that also extends through hole 246 in the housing 230. Near the upper end 280 of the rocker leg 276 is provided a generally horizontal slot 284 to receive a pin also extending through aperture 248 in the housing. Positioned below the slot is an aperture 286 to receive a rocker pin as described below.

Figure 22:
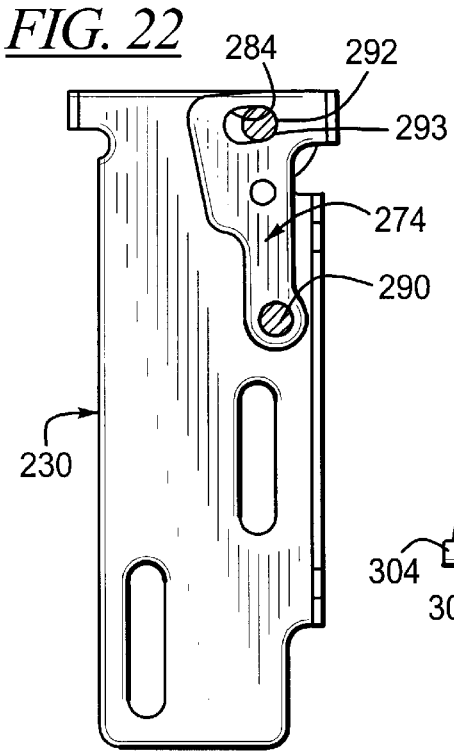
FIG. 22 is a partially assembled side elevational view of the door latch device of FIG. 17.

FIG. 22 is a cross section illustrating the arrangement of the rocker 274 relative to the housing 230 and illustrating a pin 290 extending through the aperture 282 in the rocker and aperture 246 in the housing, as well as a pin 292 extending through the slot 284 in the rocker 274 and the aperture 248 in the housing. The rocker 274 is arranged to pivot about the pin 290 through a range constrained by the length of the slot 284 which receives the pin 292. As illustrated, the rocker 274 is pivoted counter clockwise so that the pin 292 rests against a right hand edge 293 of the slot 284.

Figure 23:
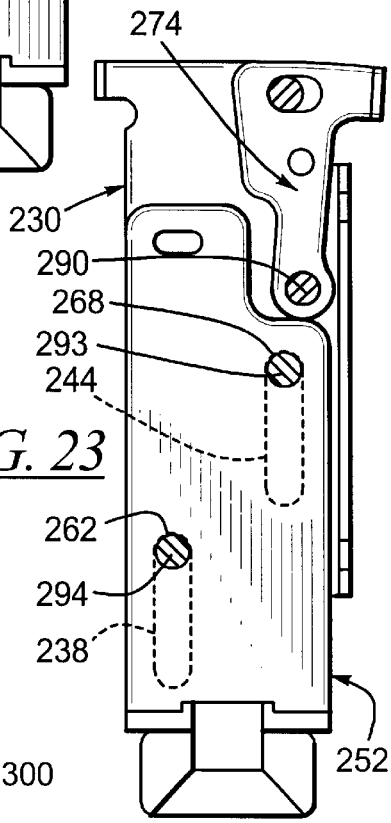
FIG. 23 is a more complete (than FIG. 22) partially assembled side elevational view of the door latch device of FIG. 17.

FIG. 23 illustrates the placement of the fork 252 into assembly with the housing 230 and the rocker 274. Here it is seen that a pin 293 is received in the aperture 268 of the fork 52 and also in the slot 244 of the housing 230. A pin 294 is received in the aperture 262 in the fork and also in the slot 238 of the housing 230. The fork 252 can slide vertically within the housing, constrained by the dimension of the slot 244 and the slot 238. As illustrated in FIG. 23, the fork 252 is slid upwardly to the greatest extent possible within the housing 230 such that the pin 293 rests on a top of the slot 244 and the pin 294 engages a top of the slot 238 of the housing.

Figure 24:
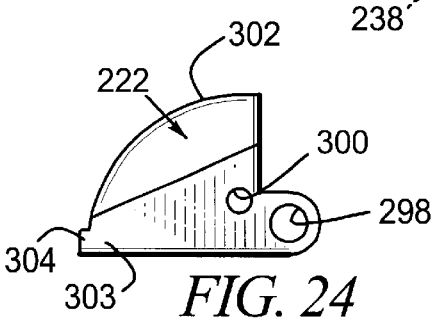
FIG. 24 is an isolated cross sectional view of a latch portion of the door latch device of FIG. 17.

FIG. 24 illustrates the latch 222 which has a first aperture 298 for pivotally receiving the pin 292 which extends through the housing 230 and the rocker 274. A second aperture 300 is provided for receiving a pin described below. The latch 222 has a curved top portion 302 which extends the full width of the latch 222. At an end of a leg 303 opposite the aperture 298 is a projection 304 which protrudes slightly beyond the curved portion 302.

Figure 25:
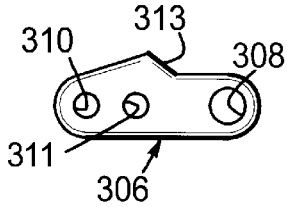
FIG. 25 is an isolated cross sectional view of a link portion of the door latch device of FIG. 17.

FIG. 25 illustrates one of two link members 306. Each link member has a first aperture 308 near one end to receive a pin (described below) extending through the housing aperture 246, a second aperture 310 near an opposite end to receive a pin (described below) extending through the slot 272 in the fork 252 and a third, central aperture 311 to receive a link pin as described below. The link members 306 also include a projection 313 formed on one edge between the apertures 308 and 310.

FIG. 26 illustrates the placement of the latch 222 and the link 306 onto the assembly of the housing 230, the rocker 274 and the fork 252. Here it is seen that the latch 222 is pivotally mounted on the pin 292 and is free to rotate about that pin. The link 306, via aperture 308, is pivotally received on the pin 290 about which the rocker pivots. The aperture 310 receives a pin 312 which is received in the slot 272 of the fork 252. The link 306 is free to pivot about the pin 290 and is constrained only due to the connection of the link 306 to the fork 252 through the pin 312, with the fork 252 being limited in its vertical motion by the pins 293 and 294 received in the slots 244 and 238 as described above. As illustrated, the link 306 is rotated about the pin 290 to its clockwisemost position since the fork 252 is in its uppermost position relative to the housing 230.

The latch 222 is free to pivot about the pin 292 through an arc where at the clockwisemost position, the projection 304 will engage an inturned tab 316 on the housing 230 and, in a counter clockwisemost position, an edge 318 of the latch 222 will engage a pin 320 carried in the aperture 286 of the rocker 274. As illustrated in FIG. 26, the latch 222 is in its clockwisemost position.

FIG. 27 illustrates one of two identical rod members 326. The rod member 326 has a first aperture 328 near a top end 330 which receives a latch pin (described below) carried in the latch aperture 300. The rod member 326 has a vertical slot 332 positioned toward, but spaced above a bottom end 334 for receiving a pin (described below) carried in the aperture 311 of the link 306 as described below. The rod member 326 further has an aperture 336 near the bottom end 334.

FIG. 28 illustrates a biasing member 340 which may be in the form of a coil spring. The coil spring has a first eye 342 for receiving the pin 294 which extends through the housing 230 and the fork 252. An eye 344 is located at the opposite end of the biasing member 340 and is received in the aperture 336 in the rod member 326.

FIG. 29 illustrates the further assembly of the rod member 326 and the biasing member 340 onto the assembly illustrated in FIG. 26. Here it is seen that the biasing member 340 is captured at the lower end eye 342 by the pin 294 and at its upper end eye 344 by the aperture 336 in the rod 326. The rod 326 is pivotally captured on a latch pin 350 which is received in the latch aperture 300. A link pin 352 is received in the slot 332 of the rod member 326 and also extends into the aperture 311 of the link 306. Thus, FIG. 29 illustrates the door latch mechanism 220, and each of its component parts, in the latched position in which the latch 222 would be engaged with the door frame 226.

Figure 30:
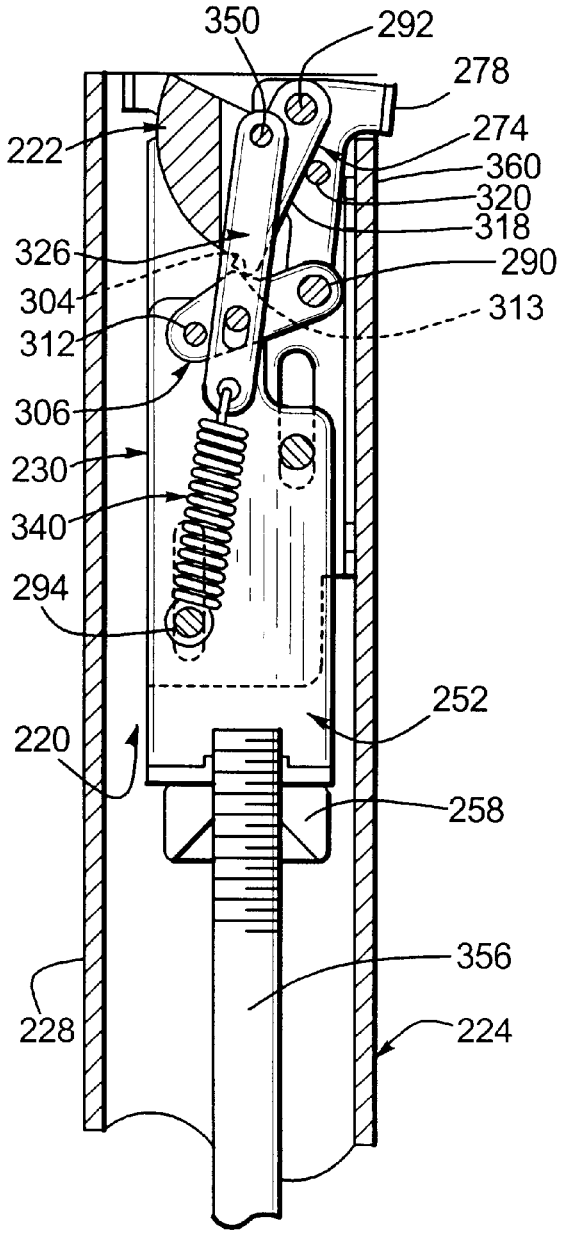
FIG. 30 is a completely assembled side elevational view of the door latch device of FIG. 17 in the unlatched position.

The door latch mechanism 220 is moved to an unlatched position by operation of a panic bar or push bar (not illustrated, but which is shown and described in U.S. Pat. No. 3,993,335 incorporated herein by reference) which causes a threaded rod 356 (FIGS. 17 and 18) to move downwardly, the threaded rod 356 being threadingly engaged in the adapter 258, thereby causing the fork 252 to move downwardly relative to the housing 230. This downward movement of the fork 252 carries the pin 294 downwardly, as well as the pin 312, thereby pulling the biasing member 340 downwardly and rotating the link 306 in a counterclockwise direction about the pin 290. This pivotal movement of the link 306 and the downward force provided by the biasing member 340 moves the rod member 326 downwardly, thereby causing the latch 222 to pivot about the pin 292 in a counter clockwise direction until the edge 318 of the latch engages the rocker pin 320. The engagement of the edge 318 with the rocker pin 320 will cause the rocker 274 to pivot about the pin 290 in a clockwise direction, thus resulting in the bridge 278 protruding beyond an inner face 360 of the door 228. This resulting condition of the latch mechanism is illustrated in FIG. 30.

When the pressure on the panic bar is released, there no longer is a downward force being exerted by the threaded rod 356, and therefore the biasing member 340 exerts an upward force on the pin 294 to move the fork 252 upwardly relative to the housing 230. However, the projection 304 of the latch 222 engages the projections 313 on the links 306 in an over center condition preventing clockwise rotation of the latch 222 and thereby stopping the upward movement of the fork 252 due to the rod member 326 and its connection to the latch at pin 350 and the link 306 connection at the pin 312 to the fork 252. The slots 244 and 238 in the housing 230 allow for lost motion to occur, permitting a slight upward movement of the fork 252 relative to the housing 230 before the projection 304 engages the links 306.

Figure 31:
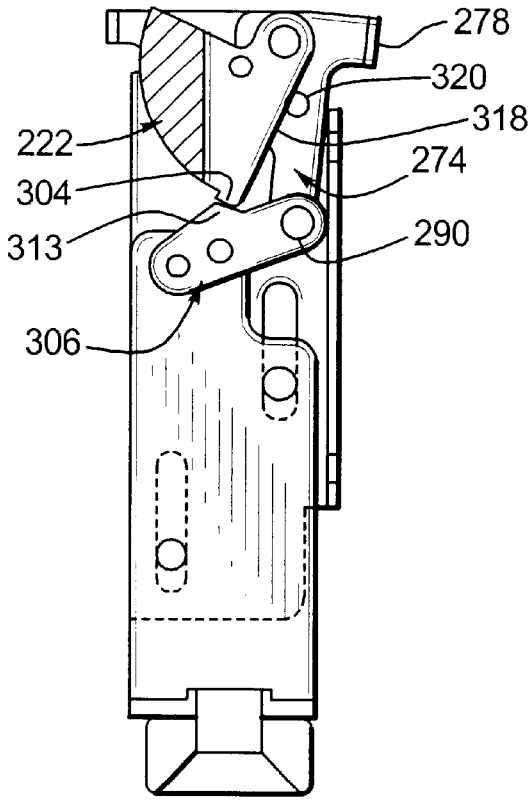
FIG. 31 is a partially disassembled side elevational view of the door latch device of FIG. 17 in the unlatched position.

FIG. 31 illustrates the engagement of the latch 222 with the links 306, with visibility blocking components removed. In this manner, the latch 222 will be retained in its unlatched position while the door remains open, even though pressure has been released on the panic bar.

When the door 224 returns to its closed position relative to the door frame 226, the bridge 278, which is now projecting beyond the face 360 of the door, will engage the door frame 226 and will cause the rocker 274 to pivot about the pin 290, causing the rocker pin 320 to press against the edge 316 of the latch 222 until the latch projection 304 moves past "dead center" on the links 306 and out of engagement with the projections 313 on the links 306, which will then release the restraint preventing the biasing member 340 from pulling upwardly on the pin 294. With this restraint released, pin 294 will be drawn upwardly, thereby carrying the fork 252 upwardly and pivoting the links 306 about the pin 290, the upward movement of the pin 352 thereby carrying the rod member 326 upwardly, causing the latch 222 to pivot about the pin 292 through the connection of the rod member 326 at the pin 350 to the latch member 222. The end result of this movement will be a return to the latched condition as illustrated in FIG. 17. Therefore, it is seen that the door latch mechanism of the present invention utilizes a lost motion arrangement in order to trap the latch 222 against returning to the latched position upon a release of the panic push bar. Also, the present invention utilizes the concept of rotating the latch 222 beyond a top dead center relative to the links 306 to trap the latch 222 against returning to the latched position upon release of the panic exit bar.

In this embodiment, the present invention utilizes a frame sensor, in the form of the rocker 274 with its rocker pin 320, to reactivate the latch 222 and move it back to the latched position by pushing the latch 222 over the top dead center position relative to the link 306.

The present invention does not require a separate striker plate or trip mechanism mounted on the door frame in order to reactivate the latch mechanism.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A latching mechanism arranged to be mounted in a door stile having a latch engageable, in a lock position, with a door frame and selectively retractable into a release position relative to said door frame upon operation of a manually operable door opening bar, said mechanism comprising:

a housing secured to said door stile;

a fork received within and slidable relative to said housing;

a rocker pivotally attached to said housing;

a link member pivotally attached to said housing and said fork;

a rod member pivotally attached to said latch; and a biasing element secured to said rod member;

said housing and said fork each having a slot engagable by a pin carried in the other of said housing and said fork to allow for limited sliding movement between said housing and said fork;

said biasing element engaged with said pin carried in said fork to bias said fork towards said rod member; and said link member carrying a pin engagable in a slot in said rod member to cause said rod member to move in response to movement of said link member, yet allowing for some lost motion to occur between said link member and said rod member;

whereupon a movement in a first direction of said fork relative to said housing results in a pivotal movement of said link member and a movement of said rod member in said same first direction, further resulting in a pivoting of said latch from said lock position to said retracted position, whereupon said rocker will be caused to pivot thereby extending a bridge portion beyond a face of the door towards the door frame and movement of a portion of said latch into engagement with said link member in an over center position; and whereupon a movement of said fork in an opposite direction will cause said latch to move into a captured engagement with said link member and whereupon said bridge portion of said rocker will engage said door frame as said door closes, a cross pin carried by said rocker will engage said latch and cause it to rotate back beyond said over center position, freeing said latch from capture and permitting said biasing element to pull said fork in said opposite direction, thereby pivoting said link member and moving said rod member in said opposite direction to pivot said latch back to said lock position.

2. A latching mechanism according to claim 1, wherein said latch comprises a projection arranged to engage said link member in said over center position.

3. A latching mechanism according to claim 2, wherein said link member comprises a projection arranged to engage said latch projection in said over center position.

* * * * *